United States Patent [19]

Pedrini

[11] Patent Number: 4,769,952

[45] Date of Patent: Sep. 13, 1988

[54] ABRASIVE-SUPPORTING HEAD FOR HONING MACHINES

[76] Inventor: Luigi Pedrini, Via Fusine, 3, 24060 Carobbio Degli Angeli (Prov. of Bergamo), Italy

[21] Appl. No.: 39,132

[22] Filed: Apr. 16, 1987

[30] Foreign Application Priority Data

Apr. 24, 1986 [IT] Italy ..... 20204 A/86

[51] Int. Cl.[4] ..... B24B 7/00

[52] U.S. Cl. ..... 51/33 R; 51/166 MH

[58] Field of Search ..... 51/33 R, 35, 90, 43, 51/166 T, 34 K, 283 R, 166 TS, 166 M, 166 H

[56] References Cited

U.S. PATENT DOCUMENTS

| | | | |
|---|---|---|---|
| 908,462 | 1/1909 | Hedstrom | 51/34 K |
| 1,662,137 | 3/1928 | Summers | 51/33 R |
| 4,136,487 | 1/1979 | Khokhulin et al. | 51/33 R |
| 4,646,473 | 3/1987 | Hundebol | 51/90 |

FOREIGN PATENT DOCUMENTS

| | | | |
|---|---|---|---|
| 3408443 | 9/1984 | Fed. Rep. of Germany . | |
| 0127657 | 8/1982 | Japan | 51/283 R |

*Primary Examiner*—Frederick R. Schmidt
*Assistant Examiner*—Robert A. Rose
*Attorney, Agent, or Firm*—Guido Modiano; Albert Josef

[57] ABSTRACT

The invention relates to an abrasive-supporting head for honing machines comprising an assembly which rotates around a vertical axis which is substantially perpendicular to the plane of arrangement of a slab being worked. The rotating assembly supports a plurality of abrasive-supporting elements which oscillate around axes arranged radially with respect to said vertical axis. The abrasive-supporting head furthermore comprises a three-dimensional bucket cam which engages with bilateral continuous contact rollers which are moved by said cam with a harmonic motion of the sinusoidal type for the oscillation of each abrasive-supporting element.

10 Claims, 3 Drawing Sheets

ABRASIVE-SUPPORTING HEAD FOR HONING MACHINES

BACKGROUND OF THE INVENTION

The present invention relates to an abrasive-supporting head for honing machines.

As is known, the abrasive-supporting heads of machines for honing hard materials, such as granite and the like, have a supporting assembly for a plurality of abrasives which rotates about a vertical axis substantially perpendicular to the plane of arrangement of the slabs to be worked.

The abrasives used in such machines, due to well-known functional technical reasons, during their rotation about the above-said vertical axis together with the supporting assembly, also undergo an oscillation respectively about axes arranged radially with respect to the vertical axis.

In order to obtain the oscillation of the abrasive-supporting elements, a cam is commonly used which is adapted for controlling, according to a specific profile thereof, the raising and lowering of one or more idly mounted small wheels, biased by the action of a return spring, each of which is generally associated with an arm rigidly associated with the supporting pivot of the abrasive-supporting element.

The use of springs in the honing heads of honing machines implies the fact that the latter are negatively affected by the harmful effects of dust produced during the operation of the machine, and by the fact that the springs, after relatively short periods of time, lose elasticity, no longer ensuring a perfect contact between the small wheel and the profile of the cam, and furthermore, in some cases, the springs are subject to fatigue breakage and therefore require replacement, which implies the halting of the machine which an adverse effect on production costs.

Moreover, as can be easily deduced, the springs give rise to a variable load on the small wheel in contact with the profile of the cam which causes rapid wear both of said wheel, which must therefore undergo replacement, and of the profile of the cam, which is irreparably damaged.

Not least disadvantage of known honing machines is that the work surface of the profile of the cam is unchanged along its entire extension so that each one of said small wheels, besides rolling on the cam, also performs harmful slippage which gives rise to greater wear and a greater work effort.

With the aim of eliminating at least partially these disadvantages, by eliminating springs, a grinding wheel head has been provided, described in German Pat. No. 3408443, wherein the control device which, during the rotary motion of the grinding wheel head, moves the sectorial grinding wheels in continuous rotary motion, is essentially composed of a disk arranged inclined towards the horizontal work surface of the grinding wheel head.

The possibility of oscillating motion of the pivots between the jaws which project outwards from the inclined disk is to be ascribed to an articulated joint fixed on said pivots.

This articulated joint thus allows the relative motion in the jaws provided on the disk.

The rotary motion of said disk, together with the middle shaft, produces an oscillating motion of each sectorial grinding wheel also between two preset angles, related to a vertical surface which passes through the axis of the pivots.

This type of grinding wheel head, though it solves the problems related to the use of springs, has an imperfect geometry, which gives rise to the wear of the components anyway, and furthermore, due to its particular structure, gives rise to the simultaneous oscillation in the same direction of two diametrally opposite abrasive-supporting elements, generating an imbalance in the rotating masses during operation, with the consequent possible generation of vibrations which cause imperfections in the finished product.

SUMMARY OF THE INVENTION

The aim proposed by the present invention is to eliminate the above described disadvantages by providing an abrasive-supporting head for honing machines which does not employ, for its operation, return springs and therefore is not subject to the disadvantages caused by their use and is furthermore provided with an extremely functional structure, maintaining a high working quality.

Within the scope of this aim, an important object of the invention is to devise an abrasive-supporting head which is extremely balanced and free from vibrations which would reduce the quality of the finished product.

Another object of the invention is to provide an abrasive-supporting head which allows only the rolling of the small wheels which control the oscillation of the abrasive-supporting elements, on the profile of the cam, since, by being provided with a perfect geometry it avoids any slippage thereof on the profile of said cam.

A further object of the invention is to devise an abrasive-supporting head which has dimensions which render it scarcely bulky and compact, since it is not provided with abrasive-supporting elements restricted by the dimensions of the cartridges of the springs.

Still another object the present invention is to devise an abrasive-supporting head in which the dimensions of said abrasive-supporting elements are extremely compact, so as to reduce the lever arms thereof, with smaller stresses of the abrasive during work.

Not least object of the present invention is to provide an abrasive-supporting head which is particularly versatile in use and which, due to the particular constructive criteria adopted, requires reduced maintenance, thus contributing to a significant reduction of production costs.

This aim, as well as these and other objects, are achieved by an abrasive-supporting head for honing machines, comprising an assembly which rotates about a substantially vertical axis, substantially perpendicular to the plane of arrangement of a slab being worked, and supporting a plurality of abrasive-supporting elements oscillating about axes which are arranged radially with respect to said vertical axis, characterized in that it comprises: at least one three-dimensional bucket cam, means for the continuous bilateral contact with said at least one cam, said contact means being movable by said at least one cam with a harmonic motion of the sinusoidal type for the oscillation of each abrasive-supporting element of said plurality of abrasive-supporting elements.

BRIEF DESCRIPTION OF THE DRAWINGS

Further characteristics and advantages of the invention will become apparent from the description of a preferred, but not exclusive, embodiment of the abrasive-supporting head for honing machines according to the invention, illustrated only by way of non-limitative example in the accompanying drawings, wherein.

DESCRIPTION OF THE PREFERRED EMBODIMENTS

Figure 1:
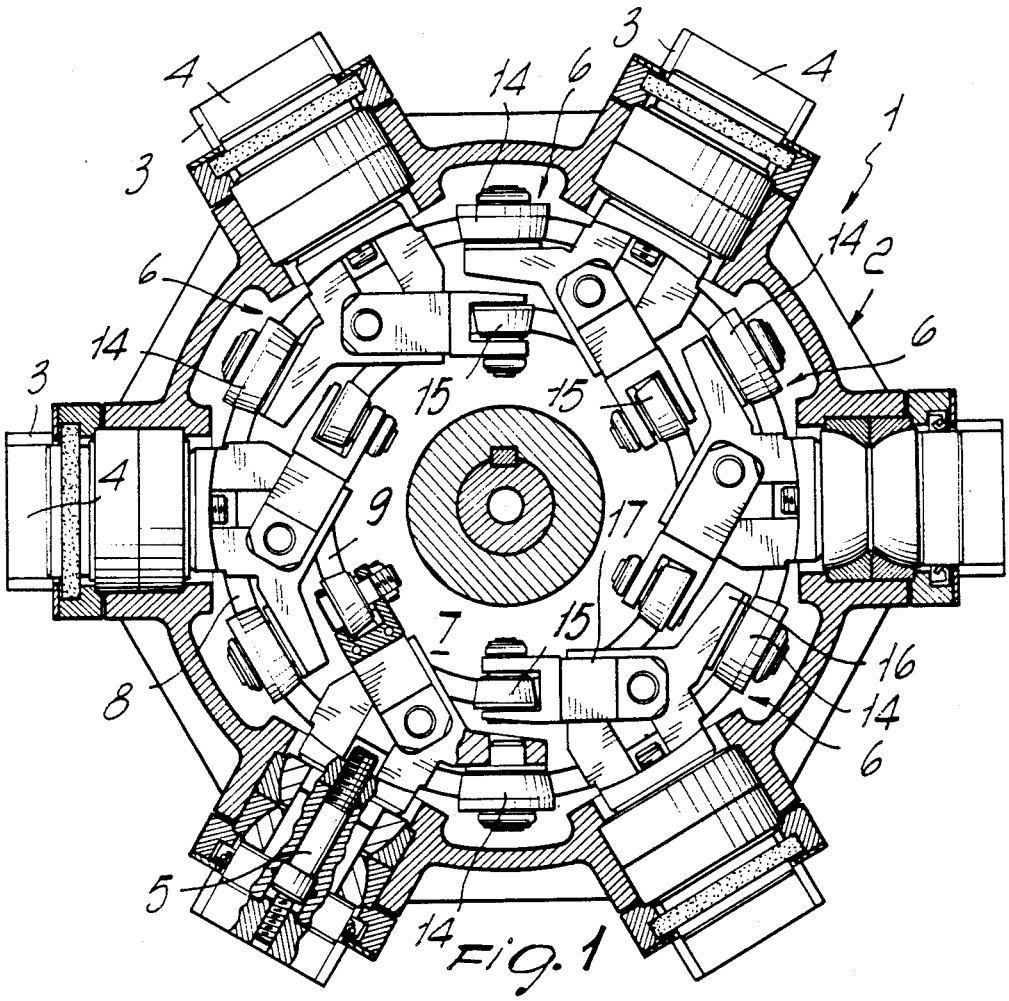
FIG. 1 is a partial plan view of the abrasive-supporting head according to the invention.
Figure 2:
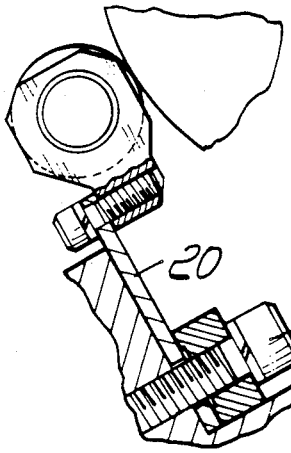
FIG. 2 is a cross section detail view of the preloading plate adapted for recovering any play between the rollers and the inner and outer profiles of the cam according to the invention.
Figure 3:
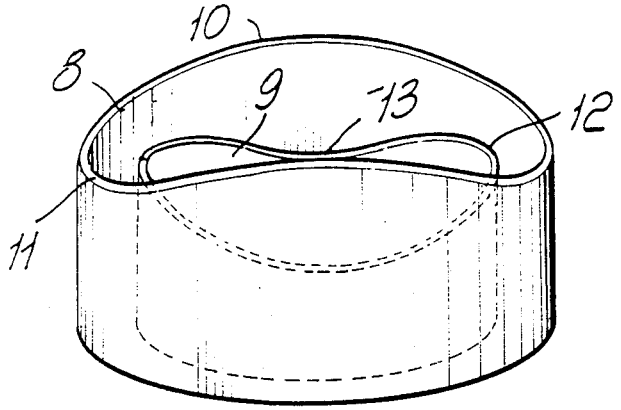
FIG. 3 is a perspective view of the three-dimensional bucket cam according to the invention.

With particular reference to FIG. 1, the abrasive-supporting head according to the invention is generally indicated by the reference numeral 1, and comprises a rotatable assembly, generally indicated by the reference numeral 2, which rotates about a substantially vertical axis, substantially perpendicular to the plane of arrangement of a plate being worked, not illustrated in the drawings, which supports a plurality of abrasive-supporting elements 3, each one adapted for receiving an abrasive of a known kind indicated by the reference numeral 4.

The abrasive-supporting elements are each provided with a supporting pivot 5 which is rotatable about its own axis and is positioned radially with respect to the vertical axis of rotation of the rotating assembly 2.

Partial rotation of the pivot 5, and therefore the consequent oscillation of the abrasive 4, is caused by the motion of contact means, generally indicated by the reference numeral 6, with respect to a three-dimensional bucket cam 7 comprising an outer profile 8 and an inner profile 9, mutually complementary.

More in detail, the outer profile 8 and the inner profile 9 are concentric and define a circular extension adapted for imparting to the abrasive-supporting element, a sinusoidal path and moreover, the distance between the upper end 10 and the lower end 11 of the outer profile 8 is greater than the corresponding distance between the upper end 12 and the lower end 13 of the inner profile 9 for geometric reasons depending on the particular arrangement of the contact means 6 above the cam.

The contact means 6 comprise first and second rollers, respectively indicated each by 14 and 15, which are rotatably associated with respective arms 16 and 17, inclined with respect to the axis of the supporting pivots 5, with an inclination adapted for allowing the rolling motion of the first and second rollers 14 and 15 by continuous bilateral contact with the respective outer 8 and inner 9 profiles of the cam, so as to be subjected, during the honing operation, to a harmonic motion of a sinusoidal type adapted for generating the oscillation of each abrasive-supporting element 3 about the axis of the supporting pivot 5.

Conveniently, in order to reduce the dimensions of the honing head, the first and second rollers 14 and 15 of an abrasive-supporting element are alternately arranged respectively coaxial to the second and first rollers of a successive abrasive-supporting element. With this particular arrangement, the first and second rollers, since they are provided with a variable distance from the pole of rotation of the abrasive-supporting head, more precisely the first rollers being spaced further than the second rollers define a first distance from said pole which is greater than the second distance of said second rollers from said pole for from said pole, are provided with different diameters and the work surface is defined for both by a same conical surface provided with its apex at said pole; moreover the mutually coaxial rollers oscillate opposite to one another along a plane which passes through the vertical axis of rotation of said head.

Advantageously, the first and second rollers have a work surface complementary to the first and second profiles of the cam, the cam profiles being in turn complementary to each other, so that during the actuation of the abrasive-supporting head the rollers roll on the profiles of the cam without any relative slippage thereof.

Figure 4:
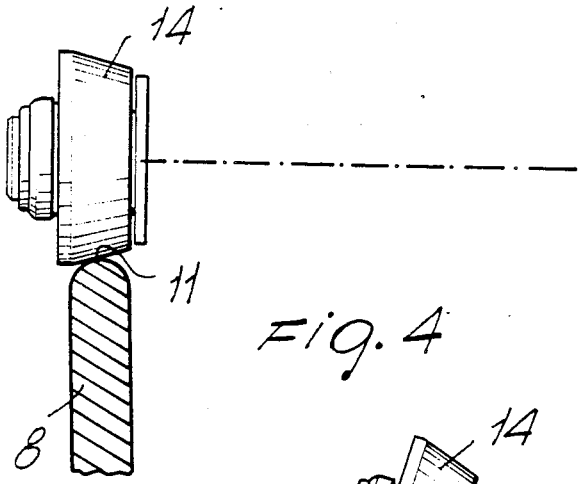
FIGS. 4, 5, 6 and 7 are schematic views illustrating the manner in which both the inner and the outer profile of the cam changes configuration according to the inclination thereon of the rollers which operate the abrasive-supporting elements so as to allow a pure rolling action thereof on the profiles of the cam, while preventing any slippage thereof during rolling.
Figure 5:
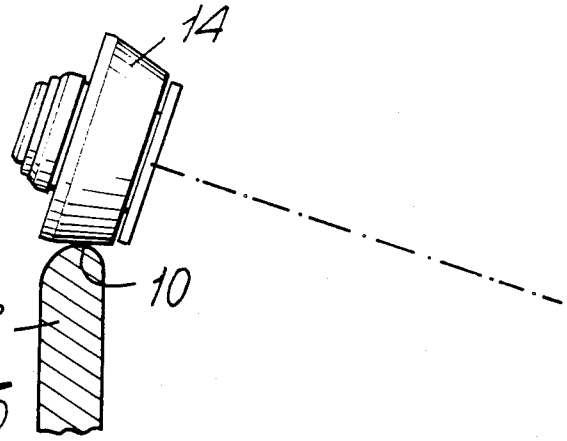
Figure 8:
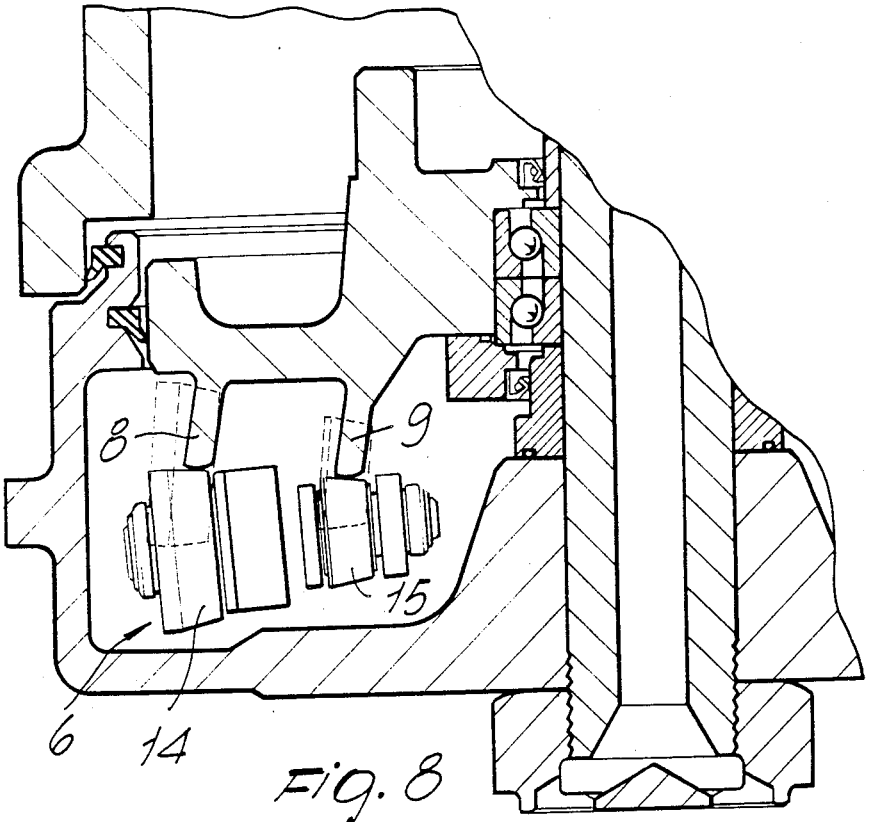
FIG. 8 is a partial lateral elevation view of a pair of rollers in contact with the respective inner and outer profiles.

Indeed, as can be seen, for example, in FIGS. 4 and 5, the outer and inner profiles of the cam have such a configuration as to allow the first and second rollers to have always and only one point of contact on said profiles, equidistant from their pole of rotation, so as to define, during their rolling, a theoretical line arranged on the surface of a theoretical half-sphere the radius of which is the average radius of said profiles.

Figure 6:
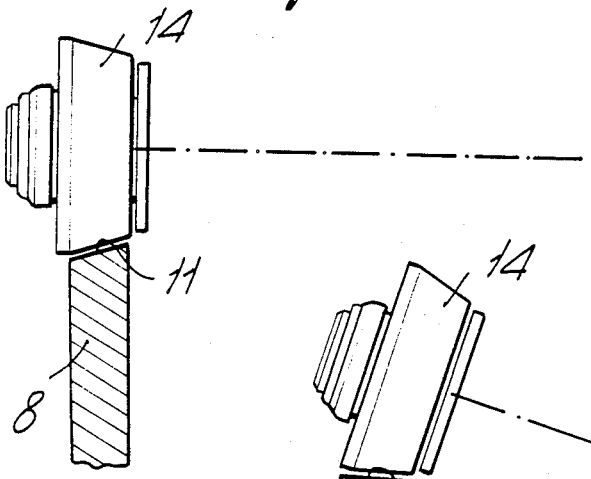
Figure 7:
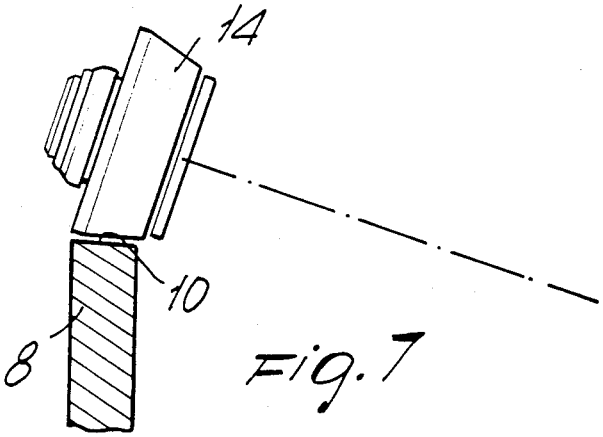

In FIGS. 6 and 7 one can observe that, for example, the contact between the first and second rollers and the inner and outer profiles occurs along the generatrix of the profiles.

Advantageously, moreover, in order to recover any eventual play, occurring, for example, during prolonged operation of the machine, the first and second rollers are respectively provided with a pre-loading plate 20 adapted for maintaining them directly in contact with the profiles of the cam after a certain tightening of the screw 21 has been performed when setting-up the machine before its operation.

In practice, it has been observed that the abrasive-supporting head according to the invention is particularly advantageous for the elimination of the use of springs which generate a variable load between rollers and cam profiles, achieving a remarkable, if not absolute, reduction of the wear of the cam and said rollers.

Moreover, the abrasive-supporting head, which is the object of the invention, allows a remarkable reduction in its dimensions, and most of all in the dimensions of the abrasive-supporting elements, which thus have a smaller lever arm and allow the forces to be overcome by the abrasive during work to be extremely small, and furthermore, by virtue of this, any shocks imparted to the abrasive cause extremely small stresses to the mechanical structures of the head.

The invention thus conceived is susceptible to numerous modifications and variations, all of which are within the scope of the inventive concept; moreover, all the details may be replaced with technically equivalent elements.

In practice, the materials employed, as well as the dimensions, may be any according to the requirements and to the state of the art.

I claim:

1. Abrasive-supporting head for honing machines comprising means defining a plane of arrangement with a slab to be worked, an assembly having a substantially vertical axis, said assembly being rotatable about said substantially vertical axis, said substantially vertical axis being substantially perpendicular to said plane of engagement, said assembly supporting a plurality of abrasive-supporting elements, each abrasive-supporting element in said plurality of abrasive-supporting elements being oscillable about a supporting pivot, said supporting pivot having a supporting pivot axis, said supporting pivot axis being arranged radially with respect to said substantially vertical axis, said abrasive-supporting head further comprising at least one three-dimensional bucket cam and roller means, said roller means being adapted for continuous bilateral contact with said at least one three-dimensional bucket cam, said roller means being pivotally associated with said each abrasive-supporting element in said plurality of abrasive-supporting elements, said at least one three-dimensional bucket cam being adapted for imparting to said roller means harmonic sinusoidal motion for causing oscillation of each abrasive supporting element in said plurality of abrasive-supporting elements about said supporting pivot.

2. Abrasive-supporting head according to claim 1, wherein said three-dimensional bucket cam has an outer profile and an inner profile, said outer profile having an upper edge, a lower edge and an extension, said extension of said outer profile adapted for imparting said armonic sinusoidal motion to said roller means and said each abrasive-supporting head, said inner profile being concentric to said outer profile, and having an upper end and a lower end, said outer profile defining between said upper edge and said lower edge a first distance, said inner profile defining between said upper end and said lower end a second distance, said first distance being greater than said second distance.

3. Abrasive-supporting head according to claim 1, wherein said roller means comprise first and second rollers, and arms said first and second rollers rotatably associated with said arms substantially inclined with respect to the axes of said supporting pivots of said abrasive-supporting elements, said supporting pivots being arranged radially with respect to said vertical axis.

4. Abrasive-supporting head according to claim 3, wherein said arms define an arm inclination and wherein said supporting pivot axis defines a supporting pivot inclination, said arm inclination extending in an opposite direction with respect to said supporting pivot inclination.

5. Abrasive-supporting head according to claim 3, wherein said abrasive-supporting head defines a pale of rotation and wherein said first and said second rollers comprise pairs of rollers, said pairs of rollers defining a conical work surface, said conical work surface having an apex, said apex being located at said pole of rotation.

6. Abrasive-supporting head according to claim 3, wherein said first rollers define a first distance from said vertical axis and said second rollers define a second distance from said vertical axis, said first distance being greater than said second distance.

7. Abrasive-supporting head according to claim 3, wherein said first and second rollers define points of contact with said outer and inner profiles, said points of contact being equidistant from said pole of rotation.

8. Abrasive-supporting head according to claim 3, wherein said inner and outer profiles have a generatrix and wherein said first and second rollers contact said generatrix of said inner and outer profiles, said generatrix having a variable inclination along said inner and outer profiles.

9. Abrasive-supporting head according to claim 3, wherein said profiles have an average radius and wherein said first and second rollers engaging said inner and outer profiles in rolling engagement relationship, and define a plurality of points, said points having a locus, said locus of said points defined by said rolling engagement relationship between said first and second rollers and said inner and outer profiles of said cam defining a line, said line being arranged on a theoretical surface of a half-sphere, having a half-sphere radius, said half-sphere radius corresponding to said average radius of said profiles.

10. Abrasive-supporting head according to claim 3, wherein at least one of said first and second rollers comprises a pre-loading plate, said pre-loading plates having adjustment means, said adjustment means being adapted for recovering play between said rollers and said inner and outer profiles after prolonged operation of said abrasive-supporting machine.

* * * * *